US011257405B2

(12) United States Patent
Moilanen

(10) Patent No.: US 11,257,405 B2
(45) Date of Patent: Feb. 22, 2022

(54) DISPLAY STRUCTURE APPLICABLE WITH ICE AND OUTDOOR CONDITIONS

(71) Applicant: LedFoil Finland Oy, Oulu (FI)

(72) Inventor: Pekka Moilanen, Oulu (FI)

(73) Assignee: LEDFOIL FINLAND OY, Oulu (FI)

( * ) Notice: Subject to any disclaimer, the term of this patent is extended or adjusted under 35 U.S.C. 154(b) by 0 days.

(21) Appl. No.: 16/956,710

(22) PCT Filed: Dec. 19, 2018

(86) PCT No.: PCT/FI2018/050945
§ 371 (c)(1),
(2) Date: Jun. 22, 2020

(87) PCT Pub. No.: WO2019/129920
PCT Pub. Date: Jul. 4, 2019

(65) Prior Publication Data

US 2020/0335019 A1 Oct. 22, 2020

(30) Foreign Application Priority Data

Dec. 28, 2017 (FI) ..... 20176180

(51) Int. Cl.
*F21S 8/00* (2006.01)
*G09F 19/22* (2006.01)
(Continued)

(52) U.S. Cl.
CPC ..... *G09F 19/228* (2013.01); *G09F 9/3023* (2013.01); *G09F 9/33* (2013.01); *A63C 2203/14* (2013.01); *G09F 2019/223* (2013.01)

(58) Field of Classification Search
CPC ..... A63C 2203/14; A63C 2203/08; F21Y 2103/10; F21Y 2105/12; G09F 19/228;
(Continued)

(56) References Cited

U.S. PATENT DOCUMENTS 3,331,912 A * 7/1967 Stricker et al. ..... H05K 3/308 174/50.52
3,463,914 A * 8/1969 Lutter ..... F21V 7/28 362/293

(Continued)

FOREIGN PATENT DOCUMENTS

CN 104201272 A 12/2014
EP 2128689 A1 12/2009

(Continued)

OTHER PUBLICATIONS

Conformal Coatings [online], [retrieved on Jun. 28, 2018]. Retrieved from <https://www.electrolube.com/products/what-is-conformal-coating.html>.

*Primary Examiner* — Omar Rojas Cadima
(74) *Attorney, Agent, or Firm* — Merchant & Gould P.C.

(57) ABSTRACT

The present invention discloses a display structure comprising at least one display module, wherein the display structure comprises at least one substrate layer comprising polymer, glass, ceramic or composite materials and integrated electrically conductive circuitry with electronics, where applicable, and light emitting devices; at least one electrically conductive layer, enabling intelligent control of the light emitting devices; wherein a display module comprises at least one coating or molded layer protecting the display structure from moist and other environmental effects; the display structure further comprises, when applicable, a number of structured, through-holes reaching through the whole display structure; the display structure is configured to be constructed from smaller, manufacturable sized display modules by interconnecting suitable amount of display modules into rows and columns; and the display structure is applicable to harsh environments comprising ice and outdoor conditions. Various coating layers and materials can be
(Continued)

selected for the ice application use and for the outdoor use. The corresponding manufacturing method is also part of the inventive concept.

30 Claims, 9 Drawing Sheets

(51) Int. Cl.
*G09F 9/302* (2006.01)
*G09F 9/33* (2006.01)

(58) Field of Classification Search
CPC .... G09F 9/301; G09F 19/22; G09F 2019/223; G09F 9/3023; G09F 9/3026; F21S 8/022; H01L 2224/16225; H01L 2224/32225; H01L 23/5386; H01L 23/5387; H01L 25/165; H01L 2933/005; H01L 33/56; H01L 2224/18; H01L 2224/24137
See application file for complete search history.

(56) References Cited

U.S. PATENT DOCUMENTS 5,450,174 A * 9/1995 Osbourne ..... G03G 15/047 399/186
7,775,674 B1 8/2010 Ward
2003/0017297 A1 1/2003 Song
2005/0248935 A1* 11/2005 Strip ..... H01L 27/3293 362/145
2010/0244231 A1* 9/2010 Yamamichi ..... H01L 23/5226 257/692
2012/0063139 A1* 3/2012 Benkart ..... H05K 3/284 362/249.02
2012/0201029 A1 8/2012 Todd
2013/0074538 A1 3/2013 Forsberg et al.
2013/0176735 A1* 7/2013 Kobayashi ..... F21S 4/10 362/249.02
2014/0111992 A1 4/2014 Yeoh et al.
2014/0218919 A1* 8/2014 Han ..... F21V 29/70 362/240
2014/0369033 A1* 12/2014 Palfreyman ..... F21V 21/005 362/183
2016/0163940 A1 6/2016 Huang et al.
2016/0254500 A1* 9/2016 Kawata ..... H02J 7/00302 362/157
2016/0349442 A1* 12/2016 Berard ..... B32B 17/10036
2017/0269797 A1* 9/2017 Lavian ..... H04L 67/10
2017/0294417 A1* 10/2017 Edmond ..... H01L 25/0753
2017/0326435 A1 11/2017 Schleuniger
2020/0066696 A1 2/2020 Moilanen

FOREIGN PATENT DOCUMENTS

RU 2484552 C2 6/2013
WO 2015/092140 A1 6/2015

* cited by examiner

DISPLAY STRUCTURE APPLICABLE WITH ICE AND OUTDOOR CONDITIONS

PRIORITY

This application is a U.S. national application of the international application number PCT/FI2018/050945 filed on Dec. 19, 2018, which claims priority of Finnish application FI20176180 filed on Dec. 28, 2017, the contents of all of which are incorporated herein by reference.

FIELD OF THE INVENTION

The present invention relates to large surface area still and video image display panels created by a matrix of discrete, intelligent light emitting source devices, which are controlled by interconnected serial data bus. Large area displays can be created by arranging smaller display modules in a large matrix. Such a technology is best suited for display panels intended for long range viewing. Typical applications would be, including, but not limited to, roadside signs and announcing in public gatherings, such as sports events.

BACKGROUND OF THE INVENTION

Typically discrete light emitting diodes are formed in an array of rows and columns to create pixels for a still or video display. By controlling each light emitting devices will form an image. Discrete devices containing multiple color emitting light sources can be used to create a range of various colors. Controlling both intensity and the level of basic colors, a display with controlled intensity and color range can be created.

Thus, the control circuitry within display matrix area is typically created in two direction (X and Y) to feed each light emitting devices its control power. This two-dimensional circuitry consumes a great deal of display surface area or, when created using multiple conductive layers, will add up substrate complexity and manufacturing costs.

Multicolored light emitting diodes (i.e. a traditional LED) with an integral control circuitry have been introduced for the market, originally intended for decorative purposes. LEDs are typically arranged in long strips, where each LED can be separately controlled by interconnected serial data bus.

Publication WO 2011/046961 (BML Productions Inc.) discloses a hermetically sealed OLED display which can be positioned below a surface of an ice layer. The display layer is placed directly below the ice, and the display layer is on top of a chilled concrete layer which in turn can be piped in order to cool this layer. The chilled layer is separated from warmer base layers by an insulating layer. Several pieces of displays can be configured together in a grid-like arrangement, i.e. in a matrix-form.

Publication WO 2015/092140 (Flexbright Oy) discloses an illumination structure which is implemented by a flexible and rollable thin film. It comprises a polymeric layer whose other side comprises a pattern (electronic circuit) layer which is electrically conductive and flexible. The structure comprises a hole for the LED flip-chip, which in turn is connected to the pattern layer through contact areas. On top of the LEDs and the polymeric layer, there is a flexible shielding layer. The thickness of the polymeric layer is mentioned to be less than 100 micrometers. The light source film is manufactured with a roll-to-roll method.

Publication US 2013/0074538 (Forsberg) discloses a panel LED display which can be located under the ice surface of an ice rink. The LEDs are placed in enclosures of the panel, and there is a cooling apparatus which circulates the coolant through the enclosures in order to remove the heat generated by the LEDs. The panel of Forsberg is a stiff and rigid panel, and an acrylic sheet made of polymethyl methacrylate (PMMA) polymer is a preferable material for such a panel.

When using discrete, multicolored light emitting devices, they typically have been arranged into a matrix, where each LED will form one pixel of the display. To create such a matric of pixels in reality, requires multiplexing and circuitry applying control to each LED separately in X and Y directions. Dense X and Y directed circuitry, required by a large amount of discrete light emitting devices control, typically occupy the most of display surface area and do not generally enable use of the space between light emitting devices for other purposes.

The prior art has problems in applying multifunctional layers within display layered structure, since complicated light emitting device control circuitry occupies too much of display surface area.

Prior art has problems in achieving sufficient reliability, using displays in challenging environments, such as outdoor locations or inside ice layer, for example within an ice rink or hockey arena ice. In trying to achieve sufficient reliability in challenging environments, prior art has had to implement high cost solutions, like separate hermetic enclosures.

Prior art has also problems in heat dissipation.

SUMMARY OF THE INVENTION

The present invention introduces a display panel product, based on serial data controlled discrete light emitting devices, arranged in a relatively loose matrix arrangement, intended for long range viewing. Loose matrix arrangement of light emitting devices will enable multifunctional use of display area for various multilayered structures and functional openings within matrix.

The inventive idea comprises of using serial data controlled light emitting devices in various embodiments of a display or illumination module structures, enabled by loose display pixel matrix intended for long range viewing and simplified power and data buses, further enabled by intelligent control of light emitting devices.

Furthermore, the inventive idea comprises various uses of the display structures and illumination modules in context with different installing platforms and application areas.

A focus area of the invention is formed by the display structures comprising layer(s) with electronics and light emitting devices applicable on various substrate materials, multifunctional layers and their structures, through-holes, and various protective layers, when the display is installed in harsh environmental conditions, such as within an ice layer of sport arena visible from the stands, or in various information signs in outdoor conditions with varying environmental conditions.

As a summary, according to a first inventive aspect of the present invention, the present invention discloses a display structure comprising at least one display module. The display structure is characterized in that it comprises

- at least one substrate layer comprising polymer, glass, ceramic or composite materials and integrated electrically conductive circuitry with electronics, where applicable, and light emitting devices (LEDs)
- at least one electrically conductive layer, enabling intelligent control of the light emitting devices wherein a display module comprises at least one coating or molded layer protecting the display structure from moist and other environmental effects the display structure further comprises, when applicable, a number of structured and manufactured through-holes reaching through the whole display structure the display structure is configured to be constructed from smaller, manufacturable sized display modules by interconnecting suitable amount of display modules into rows and columns, and the display structure is applicable to harsh environments comprising ice and outdoor conditions.

As seen in the above characterizing part, it has been defined broadly that any light emitting devices can be used; not just light emitting diodes. Thus, there is a notation where a light emitting device is marked as a "LED" in this description from now on.

In an embodiment of the invention, the apparatus comprises a plurality of arranged holes or openings for at least one of the following purposes:

enhancing the overall transparency for the apparatus providing transparency for one or more superimposed display modules, offset in a way, that allows secondary module light emitting devices illuminate via holes to same direction as primary module providing transparency for one or more superimposed display modules, this time offset and flipped to opposing directions, that is, creating two sided display allowing cooling media to flow and convect or conduct away heat generated within display structure in applications, where a large display is placed within ice layer for example in an ice rink, preventing delamination of ice layer from rink base in applications, where a large display is placed within ice layer for example in an ice rink, allows air to escape from the structure in applications, where a large display is placed within ice layer for example in an ice rink, helping the cooling of the ice layer on top of the display structure allowing optical paths for superimposed layers of other optical functions, such as sensors and solar cells providing mechanical fixing for more functional layers, such as reflectors and diffusors providing mechanical fixing locations of adjacent display modules.

In an embodiment of the invention, where the display is located inside an ice layer, instead of enclosing display modules in a high cost watertight enclosure, each display module is coated by a series of functional, protective layers, that will create an efficient protection for display structure against moisture and ionic substances, thus enabling using plain layered display modules arranged in rows and columns.

In an embodiment of the invention, where the display is located inside an ice layer, individual display modules are connected together using mechanical holder, equipped with at least two pins on each side of display module, located between adjacent sides of display modules, pins matching with locating holes at each display module sides, connecting display module rows and columns into one larger mechanical structure, that will hold its position, while ice layer is created.

In an embodiment of the invention, where the display is located inside an ice layer, individual display modules are electrically connected together using water tight connectors or silicone gel filled connectors, that will prevent water from penetrating into electrical connections.

In an embodiment of the invention, where the display is located inside an ice layer, individual display modules are protected from the effects of water and ionic substances by a multilayer coating, that comprises a thin layer providing chemically stable connection with outermost surfaces to be protected, a thick layer of elastomer providing reduction in water and ionic substances diffusion rate, but also mechanical protection against expansion taking place, when water freezes and provides means to compensate for thermal expansion differencies between ice and assembly.

In an embodiment of the invention, power and control circuitry has been created on transparent substrate to allow general transparency of display.

In an embodiment of the invention, two or more superimposed display modules are used to create denser pixel structure or higher illumination level.

In an embodiment of the invention, two or more superimposed display modules are used together with computer generated display controls directed separately to each display in order to create 3D effects.

In an embodiment of the invention, two or more images are sent to single or superimposed display modules, forming a foreground and/or a background for a visual image in order to create 3D effects.

In an embodiment of the invention, display is equipped with reflectors for each light emitting device in order to collimate the light beam to a desired illumination angle and reduce optical interaction between adjacent light emitting devices.

In an embodiment of the invention, display is equipped with a diffuser layer, that will diffuse light beams for more even illumination and enhanced optical properties of the display.

DETAILED DESCRIPTION OF THE EMBODIMENTS

Figure 1:
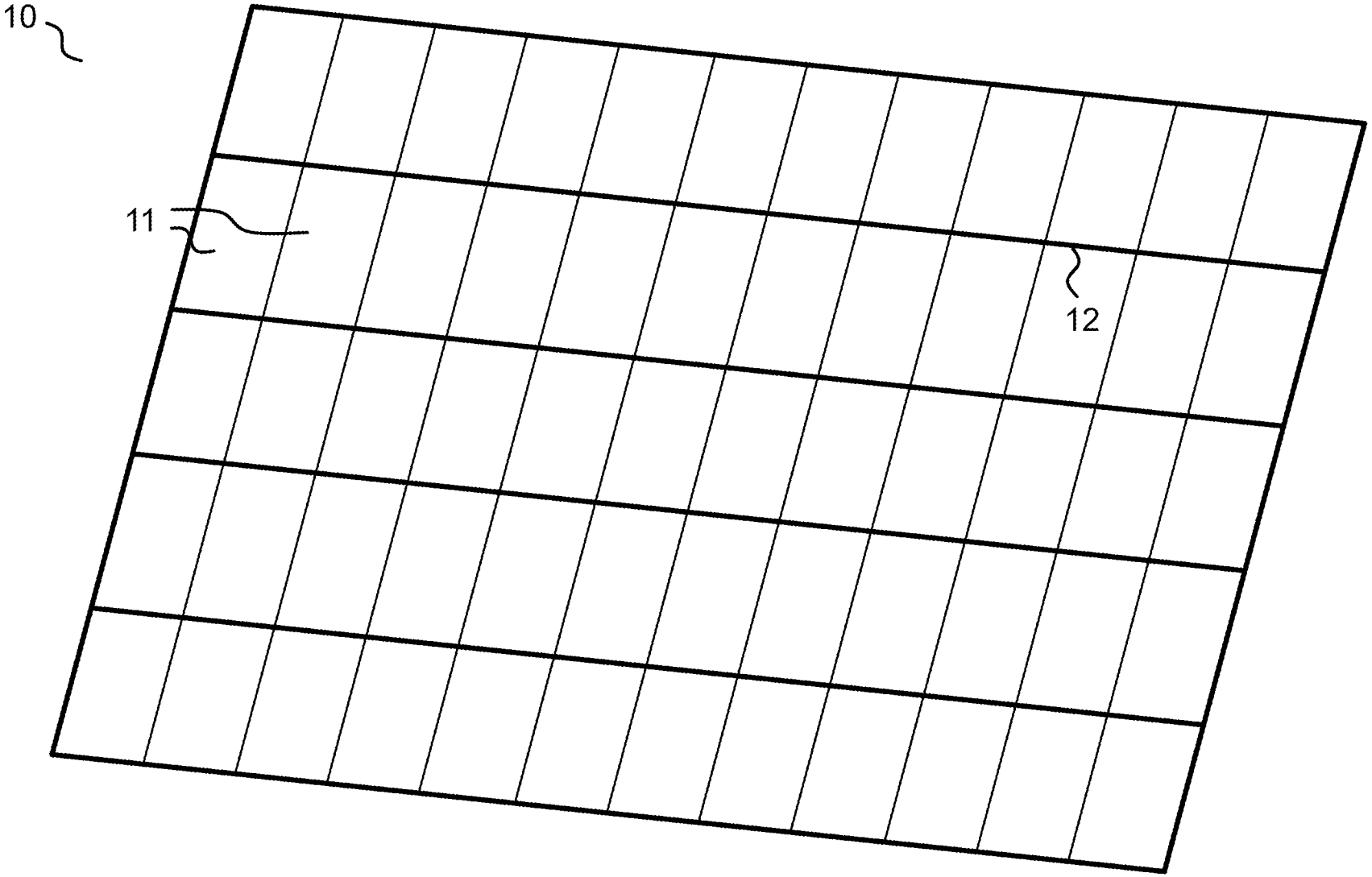
FIG. 1 illustrates a modular structure of a display according to an embodiment of the invention.
Figure 2:
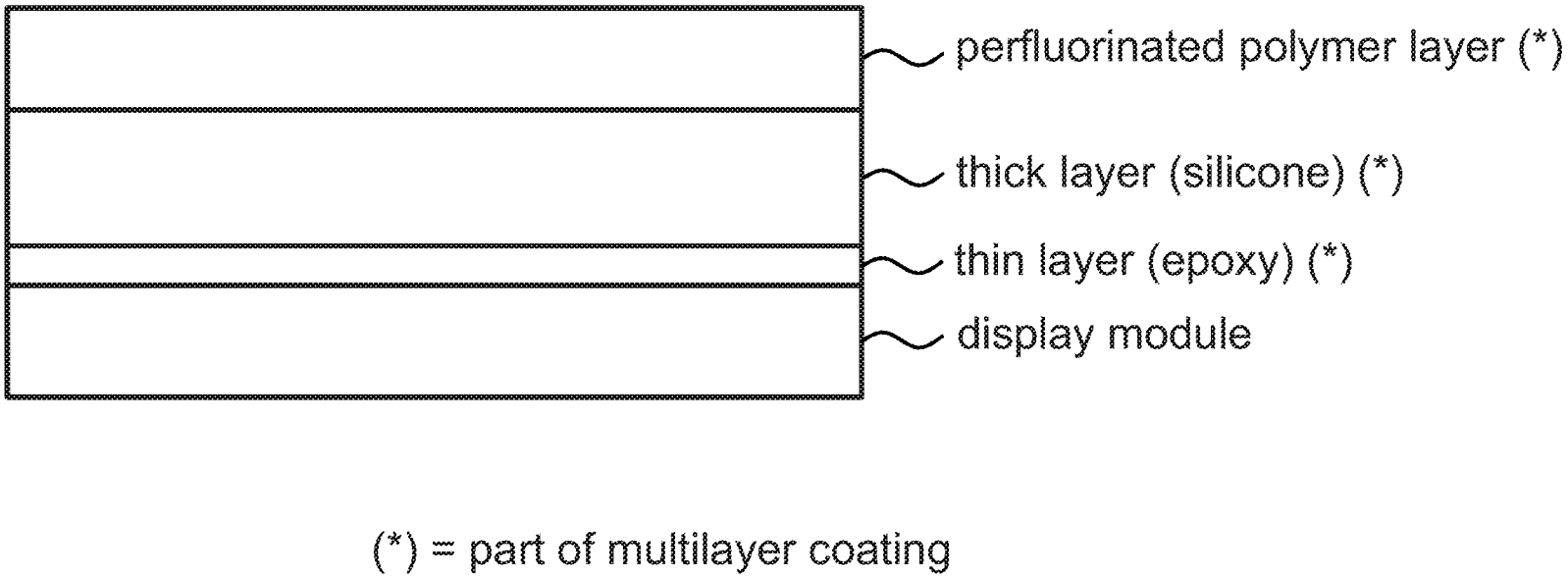
FIG. 2 is a diagrammatic sectional side view showing the thin and thick layers, the multilayer coating, and the multilayer coating.
Figure 3:
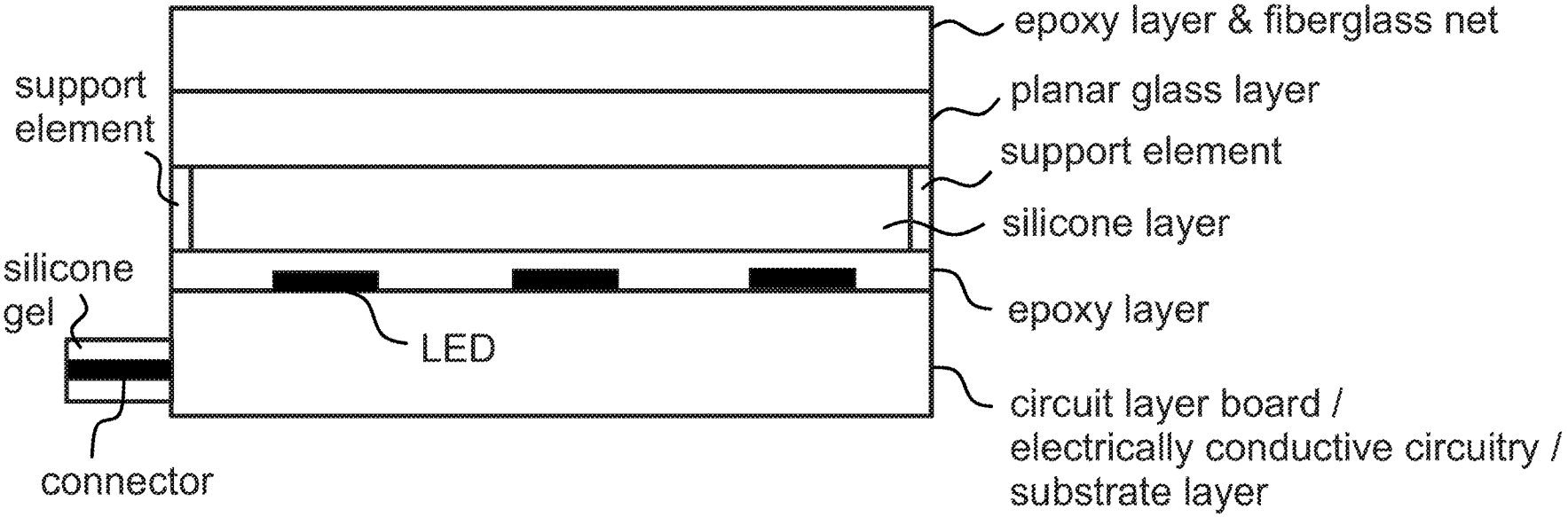
FIG. 3 is a diagrammatic sectional side view showing the planar glass layer on the silicone layer, the silicone layer on the epoxy layer and the epoxy layer on the circuit board layer, the support elements, the connector filled with silicone, the light emitting devices on an FR4 circuit board, and the epoxy layer laminated on a glass layer.
Figure 4:
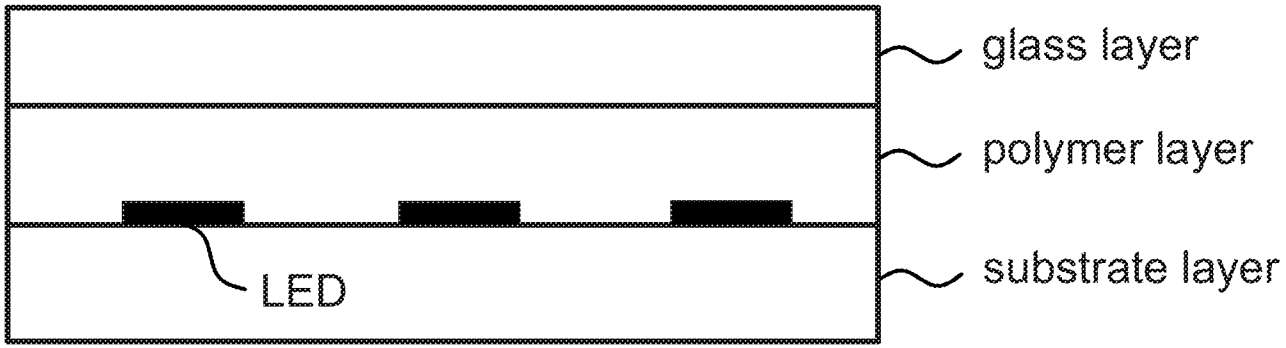
FIG. 4 is a diagrammatic sectional side view showing the substrate topped by a polymer layer, and further topped by a glass layer.
Figure 5:
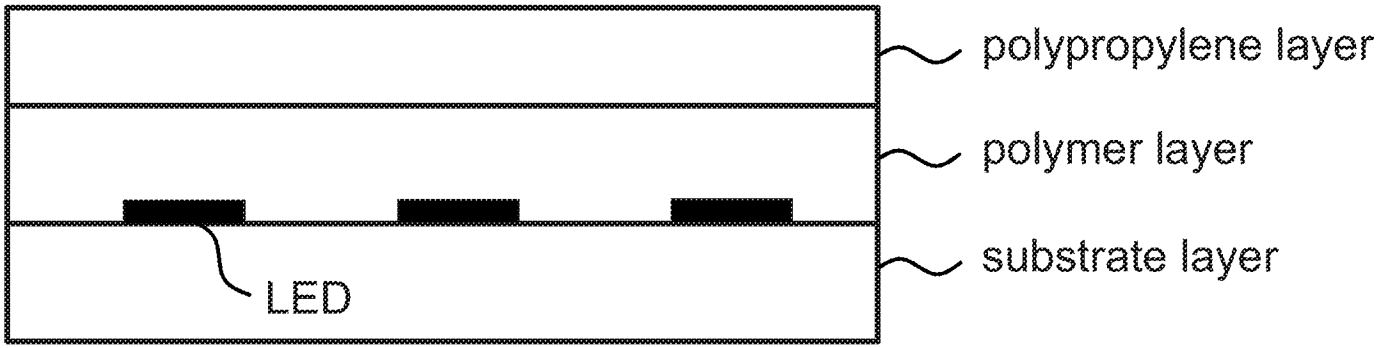
FIG. 5 is a diagrammatic sectional side view showing the substrate topped by a polymer layer, and further topped by a polypropylene layer.
Figure 6:
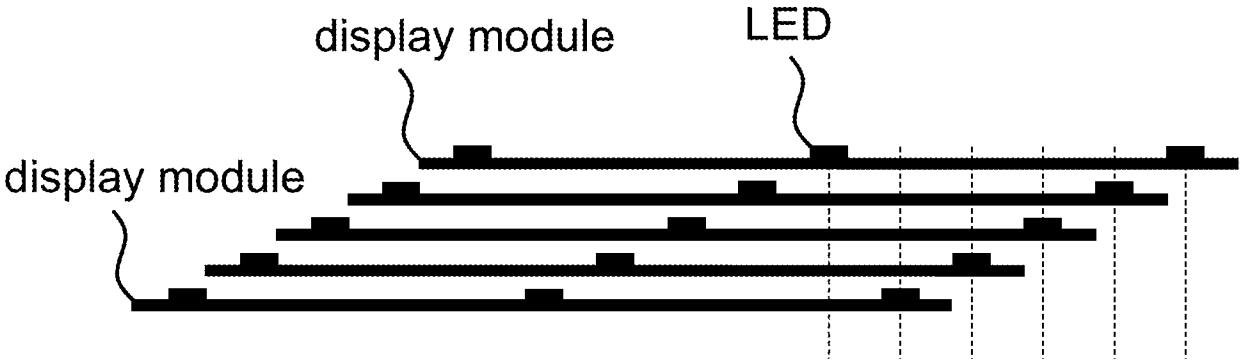
FIG. 6 is a diagrammatic view showing two or more superimposed display modules.
Figure 7:
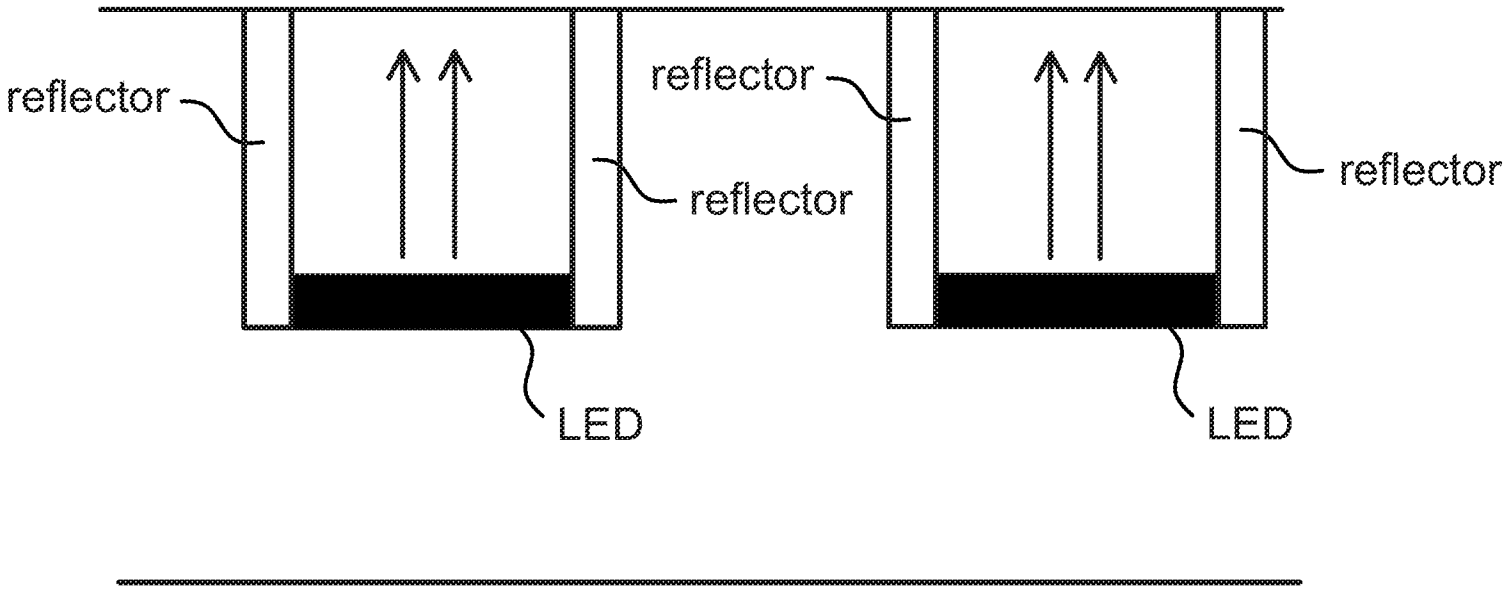
FIG. 7 is a diagrammatic sectional side view showing reflectors for each light emitting device.
Figure 8:
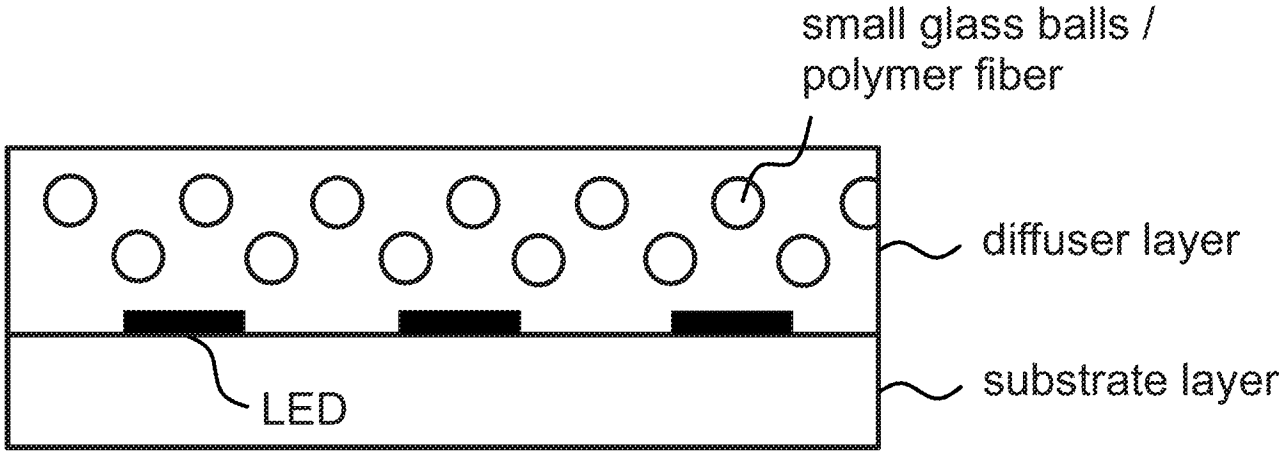
FIG. 8 is a diagrammatic sectional side view showing small glass balls of polymer.
Figure 9:
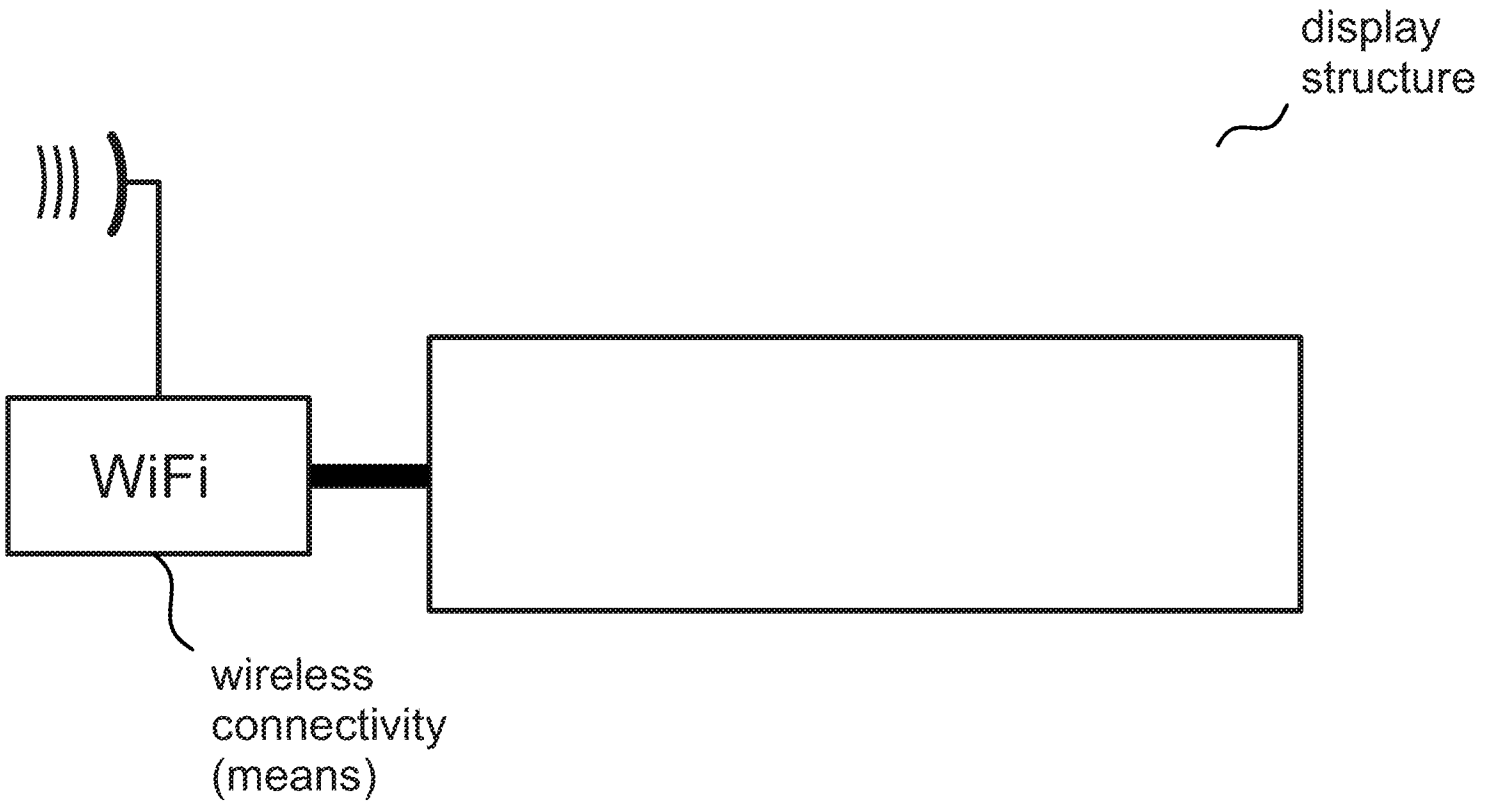
FIG. 9 is a diagrammatic view showing wireless connectivity.

The present invention introduces layered substrate-based display structures applying LEDs (meaning broadly Light Emitting Devices) and illumination device structures to display full-color or black-and-white still images or video for visually displaying information, or for illuminating purposes. The present invention also introduces other substrate materials, structural features and specific layer structures and materials for application areas comprising a so-called ice display application and outdoor use application. These matters are discussed in detail later in this description.

The present invention may use a variety of substrate materials. Substrate materials are selected according to available technology and suitability of substrate materials for various environmental conditions prevailing in the location of installation.

The device comprises at least one module where each module comprises at least one layer where different layers may have different functionalities. In the following, where merely the display structure is discussed, it is meant to include both the displaying devices and illumination devices. The display structure may comprise a LED layer comprising a plurality of LEDs and desired electrical circuitry meaning electrically conductive patterns with contact areas for components. In case the structure comprises several LED layers, the corresponding structure is referred as a LED layer arrangement. In a similar fashion. In some embodiments of the invention, the structure may comprise electric energy collecting means such as e.g. a solar panel, and electric energy storage means such as at least one accumulator unit or battery. All these functions may be implemented with a single main functionality per a corresponding layer, e.g. a battery can be formed through having one or more battery layers among the layered structure. In case the structure comprises several battery layers, the corresponding structure is referred as a battery layer arrangement. The battery or batteries can preferably be rechargeable, which can be used for storing solar energy, for instance. Alternatively, instead of a battery layer (arrangement), an external battery means may be used. A single electrically conductive layer may be patterned for creating conductors of an electric circuit which enable the operation of the display or illumination device. In an example, electrical circuitry comprises the input supply of the electric current for the LEDs, and also a control signal which is used to drive the LEDs in order to create the desired image. Because LED types are various, it is meant that appropriate wirings of electrical conductors are selected for the selected LEDs. Of course, different layers require dedicated electrical circuitry as well. In the invention, the electric supply can be provided from mains current to the LED display. In another embodiment, the display structure has an independent electric supply creation means, e.g. through a solar panel layer along the structure. A part or all these functional parts can be implemented as a layered element or by connecting or adding elements or material onto a substrate, and the surface dimensions of a single layer are freely scalable and selectable according to the used application.

In the present invention, the used LEDs may be encapsulated one or multi-color SMD LED components, or alternatively bare LED chips may be used.

In an embodiment of the invention, each used LED is an encapsulated RGB LED or an encapsulated RGBW-LED. Alternatively, the used encapsulated LEDs may be merely single-color LEDs, such as R- (red), G- (green), B- (blue) or W-LEDs (white). Alternatively, bare LED chips may be used instead of the encapsulated single-color LED chips. The required wiring and control method of the LEDs is selected based on the selected type of the LEDs.

In a preferred embodiment, a light emitting device matrix is provided with through-holes, where the hole diameter and density (number of holes) per surface area can be freely selected. The use of holes will enhance the transparency regarding the visible light, and it also provides possibilities for the air and water to penetrate through the display structure.

In one embodiment of the invention, it is referred to a modularly formed LED display structure shown in FIG. 1. The illustration exemplifies a LED display 10 where the LED display comprises a plurality of display modules which are fixed on a frame structure 12. The frame structure 12 is preferably a rigid element and it can be shaped in a planar or non-planar shape. In one example, it is possible to install power supply and signal cablings inside or along (placed on top of) the frame structure 12, where they are also better protected from physical twisting movements or harmful moisture, for instance. A single module 11 of the whole structure may be a longitudinal strip, or it may be a piece-like module with desired dimensions. In FIG. 1, the frame structure 12 comprises horizontal bars within a rectangular frame. The modules 11 are shown as vertical strips and they are placed adjacently with each other so that all strip-shaped modules are placed orthogonally in view to the horizontal bars of the frame 12. In that case, the modules 11 can be fixed to the frame 12 in locations, where these two elements intersect.

The frame structure 12 can comprise electrically conductive wires, which can be connected to desired locations of the modules. Alternatively, some sections or the whole frame structure can be built without wires, and especially, if only a single module is used in the apparatus.

In another embodiment, it is possible to place modules 11 in parallel direction with the horizontal bars of the frame 12 (not shown in FIG. 1). In that case, the edges of each module 11 can be fixed to the frame 12 along the whole edge, or just in designated locations along the edge.

In one embodiment, the strip-shaped modules 11 or piece-like modules can be attached to the frame 12 by using a plurality of connecting means. The connecting means may be made of either conductive or insulating material. The connecting means may be e.g. pins or rivets, but various other elements can also be used for this task. For simplification, merely pins are discussed in later embodiments but any connecting means can be applied in practice. In practice, the two adjacent modules can be both attached to the bar of the frame 12 with a linear assembly of pins. The pins can be electrically conductive, and they can be used for instance for feeding electric supply carried by the wirings in the frame structure to certain designated points in the display structure. However, some of the pins may be insulating (i.e. non-conductive) material, and such pins may be used in attaching the modules to the frame structure. Thus, the pins may be either conductor pins or insulator pins, and this applies to other used connecting means as well.

Concerning alternative options for pins, other connecting means such as screws, studs, spikes, crimp connectors or also other connecting arrangements can be used.

Concerning the example of FIG. 1, the pin connection points can be selected e.g. in the "corner points" where the edges of a module coincide with the frame sections. Additional connection points between the pins and the frame structure can be selected along the seams between two adjacent modules, or along the frame sections, e.g. with uniform spacings.

In another embodiment, the pins can be arranged to fix several layers together e.g. in a line-shaped arrangement. It is possible to place the pins through e.g. one or two overlapping layers and fix these layers onto the frame. This is especially beneficial with the layer structure where layers are a little bit misplaced between each other, in order to place the LEDs uniformly to the whole structure.

A yet further embodiment of the invention, and actually an application area for the presented display or illumination arrangement is a display or illumination device which can be placed below or inside a layer of ice. This is discussed later in even more detail. This means that the display structure with a single viewing direction can be placed on a fixed platform, such as on a concrete layer. In the ice application, the substrate layer or some layers of the display structure can be non-transparent, because the structure lies on an opaque base. There are holes in the display structure in order to enable matter such as water or remaining air under the display structure to flow through the display structure in order to enable the water and/or air to exit the structure before the freezing takes place. This helps to make the structure as smooth and planar without any air bubbles trapped within the structure, thus easing the laying of the good-quality ice layer on top of the display structure and preventing delamination of the ice layer from the base of the rink. The LED layer(s) need to be provided with a protective layer in order to prevent any water to enter into the structure. The display structure acts as a platform for a next layer which may be an insulating layer. Normally the cooling layer locates in the bottom within a concrete base, and the display structure is placed on top of the cooling layer. In that way, the cooling will have an effect through the holes within the display structure and LED layers into the ice placed on top of the whole structure. In one embodiment, the display structure can be located within the ice layer so that the distance of the display structure from the top surface of the ice can be selected to enable the best view of the display through the ice. In another embodiment of ice display structure, heat generating light emitting devices and/or whole upper surface of the display structure can be equipped with an insulating layer, which will prevent power dissipation from affecting the ice quality. The resulting effect is a display or an illumination arrangement visible through ice.

In an embodiment of the invention, protective layers applied over the display structure may contain materials or separate material layer can be applied over one or more of the protective layers, which separately or at the same time act as an insulating layer, a dispersing layer and a diffusing layer. Such material properties comprise low thermal conductivity (thermal insulation), an index of refraction differing from surrounding materials (dispersion) and it would contain optical interfaces directing light in various directions (diffusing). Especially suitable for this purpose would be hollow, thin-walled glass spheres, but also other materials having desired thermal and optical properties can be used for this purpose.

In other words, regarding insulation in ice display applications, protective layers may comprise thermally insulating material or a thermally insulating layer may be applied on top of one or more protective layers, that enables directing the dissipated heat by the display structure towards a desired side of the display structure in ice display applications. Such a structure prevents warming and softening of the ice which locates above the display structure. Despite that, the cooling effect from the cooling apparatus beneath the display structure is able to move upwards right up to the top of the ice because the through-holes of the display structure form "channels" for the propagation of the cooling effect. Thus, an insulating layer or material locating on top of the display structure would direct a major part of the thermal load created by the display structure back down into the cooling base layer beneath the display structure.

In one embodiment of the ice application, the temperature of the ice layer can be measured and in case the temperature is above a given threshold value indicating a melting possibility for the ice, the control system of the display structure can control and manage the output power fed to the LEDs. This enhances the quality of the ice through cooling the ice layer well under the threshold. The threshold can be slightly below 0° degrees, as an example.

In one embodiment, the display or illumination structure may comprise a sensor layer using e.g. temperature sensors used to measure the temperature, or optical sensors used for visual inspection of the quality of the ice.

The applications comprise different ice-covered arenas, such as ice hockey rinks. All the required lines and markings for the ice hockey games might be created through the ice-integrated displays. Also, it is possible to create various other lines and field limits for other sports than just e.g. ice hockey, in a multi-sports venue. This also applies for any indoor or outdoor sports field without any ice. Furthermore, the displays can be used in creating fixed or modifiable advertisement spots visible through the surface of the ice. The modifying capability of the created ads is a great advantage because there would then be no need to remove the ice when there is a need to change advertisements beneath the ice. Of course, the principles of the invention are well suitable to all other locations available in a sports venue, such as for guidance or advertisement means on the walls or windows or dedicated information displays in a sports arena, or as a main or additional result board within the venue or e.g. on rink walls or within a plexiglass surrounding the ice hockey rink. The options in this regard are plentiful.

Regarding the embodiments below a solid transparent material layer such as ice, the solid ice layer also acts as a diffusor element for the light sources. This means that single LEDs are not that easily visible farther away from the display structure. Regarding the desired quality in the created images in the display, this might have an effect to the LED resolution within the display structure, or to the thickness of the transparent solid material on top of it.

The inventive idea comprises also a corresponding manufacturing method for display or illumination apparatus. The manufacturing method for manufacturing a display structure, comprising at least one display module, comprises the steps of:

- manufacturing each layer of at least one substrate layer comprising polymer, glass, ceramic or composite materials and integrated electrically conductive circuitry with electronics, where applicable, and light emitting devices
- manufacturing at least one electrically conductive layer, enabling intelligent control of the light emitting devices
- manufacturing, for each display module, at least one coating or molded layer protecting the display structure from moist and other environmental effects
- routing or otherwise creating in the display structure, when applicable, a number of structured through-holes reaching through the whole display structure
- constructing the display structure from smaller, manufacturable sized display modules by interconnecting suitable amount of display modules into rows and columns, wherein
- the manufactured display structure is applicable to harsh environments comprising ice and outdoor conditions.

All mentioned layers, and also the disclosed material and device properties of the display structure, can be manufactured by an embodiment of the above manufacturing method. In other words, all disclosed characteristics and various embodiments of the display structure are obtained by manufacturing the display structure according to a corresponding embodiment of the manufacturing method.

The manufacturing method can be implemented partly or fully by a computer program which is executable on a processor or other computing means. The computer program comprises code and it may be stored in a computer-readable medium.

Now discussing new application areas and characteristics of the display structure with these other application areas, we refer to the following.

A first inventive application area is a display structure below an ice surface, which has been briefly covered above. The ice display application has to be such that when the icing process is done with the laid-down display structure, the water must fill all the gaps so that the structure will freeze uniformly within the outdoor surfaces and gaps of the display structure. Water should reach all places without any intermediate air volumes. When the ice has been formed, it fixes the display structure naturally in its place, also through the holes and gaps. This also means that different layers will be fixed within the ice, either with or without the outside frame. These advantages also relate strongly to holes in the display structure which are also discussed later.

A second inventive application area is a display structure suitable and applicable to outdoor environments or to interfaces between indoor and outdoor spaces. A useful end product is formed by various road signs, especially changeable road signs, information screens and traffic lights and even advertising displays beside the roads and on the windows and walls of buildings or as a separate advertising structure marking e.g. a bus stop. The outdoor conditions mean that the materials and the electrical connectors are subject to various temperature variations and also moisture conditions vary significantly.

In the outdoor display structures, there is usually a frame and the display can be screwed onto a matrix-like arrangement. In case of a rectangular info sign applied e.g. besides or above the road, it is beneficial to provide the electrical input either from the top or from the bottom of the structure. The modules within the matrix can be formed by putting vertically aligned longitudinal display modules side-by-side so that the resulting rectangular information sign area is fulfilled.

A beneficial structure for outdoor displays is formed by the following three-layer structure. The first layer is a circuit board coated with epoxy, and the third layer is planar glass layer. Between these layers, as a second layer, there is silicone gel. The first and the third layers can be interconnected from the sides or desired locations by support elements which define their mutual gap width. This gap is then filled with the silicone gel. Of course, the display structure to be molded with silicone gel can have through-holes as described earlier to assist evacuation of possible entrapped air in the final structure. This structure may also be used as part of a 3D-display, which in turn can be formed from one, two or three modular elements.

Generally speaking, the outdoor display structure can have an internal battery and thus, it can be even a portable display structure. It will consume rather small amounts of energy, making this kind of power supply possible. This kind of display application will be useful for use by various authorities, such as police, ambulance personnel, fire brigade, road construction workers and other people working in the field conditions.

Despite the early discussed coating principles, the present invention can apply a coating method selected from the following group of coating methods: laminating, spraying, electrostatic spraying, molding, injection molding, dipping, jetting, casting, curtain coating. These methods can be used in any layer and coating structures presented in the various examples. At least dipping is an advantageous way to manufacture the coating layer.

Regarding connection principles between different layers, mechanical or electrical connection means can be used. The mechanical connection can be formed by protrusions or spikes, or any elements popping from the surface of the layer so that a connecting counter-hole can be set to the spike, enabling the mechanical connection. Naturally, the number of spikes per area can be selected so that the connection quality is sufficient. An electrical connection between the layers means that there are coinciding wires, possibly with small connectors, which enable the electrical connection. It also enables feeding of several possible LED layers through just providing electrical input to a single layer. In practice, the electrical connection can be implemented by a connector filled with silicone gel, which does not allow any water to enter the electrical contact during the freezing process of the water. One option for the electrical connection is to use a three-lip connector which has been applied already in the automobile industry.

The material of the substrate can also be selected differently than by just picking a single polymer material. One option for the substrate is to use FR4, a traditional circuit board material but in the context of icy application locations it forms a novel concept. FR4 is a composite material composed of woven fiberglass cloth with an epoxy resin binder. FR4 is good for situations such as places where good stiffness is required and FR4 is also flame resistant, and further, FR4 also makes possible some dynamical forces which affect the substrate because of changing temperatures. FR4 has also endurance against the effects of the moisture.

Further options for the substrate material are glass, ceramic materials, and composite structures comprising e.g. a glass layer and a polymer layer, or e.g. an organic layer and a ceramic layer. Durability is an important characteristic of the selected substrate material. Glass has an additional advantage by being a waterproof material as such. Even polymers filled with ceramic materials can be considered, for instance "LCC" (i.e. Layered Ceramic Composites). In order to obtain good endurance against scratches, a polymer layer topped with a glass layer will provide good quality surface in this regard. One advantageous material is formed by an epoxy layer which is reinforced with a fiberglass net because it can be further laminated to a glass layer. In an embodiment, composite layers can be selected freely from the group of a polymer layer, an organic layer, a ceramic layer and a glass layer. There can be one or more similar material layers within the composite material, in a freely selected order. More specific layer combinations are discussed in the following.

A first advantageous embodiment of the layer structure comprises a passivating epoxy coating layer nearest to the electronics, wirings and LEDs which offers chemical protection against the water and ice. This is a relatively thin layer. Epoxy is a material comprising epoxy groups, i.e. epoxides, which passivate the surface of the substrate where the electronics and wirings together with LEDs locate. This is particularly useful when there is a possible interaction with liquid water, present during the freezing process of the ice e.g. in the hockey arena before the complete freezing is obtained, or if there is partial undesired melting of the ice during the actual usage of the display under the ice. The epoxy layer diminishes the corrosion occurring within the materials of the display structure. It also acts as an adhesion layer for the rest of the used coatings (if they are applied).

According to a further sub-example within the first advantageous embodiment, the thickness of the epoxy coating layer is selected from 0.05 mm-0.2 mm.

Because the epoxy layer is relatively hard in cold temperatures, mechanical forces may break a display structure coated only with epoxy. In order to prevent breaking of the structure, a further protective layer can be formed by a relatively thicker silicone-based coating layer placed on top of the epoxy coating layer. This forms a second advantageous embodiment. The silicone coating layer offers mechanical protection against the dynamical forces created by ice expansion (in comparison to liquid water). The silicone layer also offers extra protection in chemical sense and based on its density, it won't let the layer structure move during the freezing process.

According to a further sub-example within the second advantageous embodiment, the silicone-based coating layer may comprise either polyurethane or acrylate for further protection from mechanical stress. Such an added material increases the softness of the silicone-based coating layer.

Furthermore, according to a third advantageous embodiment, a further chemical protection is added to the second advantageous embodiment by a perfluorinated polymer coating layer on top of the silicone coating layer. This can be added only partially to a selected sub-area of the silicone coating layer surface. Perfluorinated polymers have an advantage that they repel water (as liquid or vapor), i.e. it is a hydrophobic substance. Thus, it is well applicable in hockey arena use (i.e. ice applications), as well as in information, advertising or traffic signs (i.e. outdoor applications).

According to a further sub-example within the third advantageous embodiment, the thickness of the perfluorinated polymer coating layer is selected from 1 μm-5 μm. As an alternative to the use of a perfluorinated polymer, parylene may also be used as a protective coating, as it is a good barrier against moisture.

A fourth advantageous embodiment of the layer structure comprises the electronics layer at the bottom, a polymer layer on top of it, and a glass layer as the topmost layer in the ice display application.

A fifth embodiment applicable especially to outdoor use comprises an electronics layer at the bottom, a polymer layer on top of it, and a plastics layer as the topmost layer. Such plastics can be selected to be e.g. polypropylene.

Generally regarding very thin and flexible substrates comprising the desired circuits, it can be supported by a carrier plate. This is generally useful for substrate thicknesses below 0.5 mm.

A further application area is to enable creation of a 3-dimensional image with the display structure according to the invention. This can be created by having a separate layer for each created image, and controlling each image within each layer so that a 3D effect is visually obtained for the viewer. A problem within the 3D display structure is that its good watching angle is quite narrow. A solution to this problem is to have various optical aids, such as light guides and/or reflectors added to the structure.

Regarding the wires used within the display structure (e.g. on top of the substrate), a useful material selection for the wirings is copper (Cu). Copper should be coated with some material in order to prevent thermal conduction and also to prevent corrosion. One suitable material on top of many non-polymer substrates is tin (Sn) which has very good corrosion prevention characteristics. Also, the thermal endurance of a tin coating on top of a copper wire is very good. Generally, a solder mask passivating the Cu material surface chemically, is useful. An example of a solder mask material is epoxy.

An essential part of the invention in the ice application is that there are holes (meaning through-holes) in the display structure. This enables good freezing of the water when the ice layer is formed onto and around the display structure e.g. in an ice hockey arena. The holes in the display structure prevent delamination of the ice from the concrete base. The icing process will progress most efficiently when holes are present because the air and the water may flow freely through the holes until the freezing takes place. Also, the fixation of the whole structure will occur through the holes as well. Also, the display itself with the holes will be less thermally insulating, and thus, it will make the ice layer quicker and the ice temperature will also remain below 0° C. in an easier manner, making the ice remain in better quality when the display with its LEDs are in operation.

The applied holes in the display structure can be formed in various different shapes. The manufacturing method for the holes can be routing. These include a round-shape, a square or rectangular shape, or an elongated or longitudinal or an ovally formed hole shape. This has a beneficial application area in solar panel structures which are integrated with the display structure because the holes will increase the transparency of the whole structure. This in turn enhances the solar energy reception onto the solar cells.

Furthermore, a coating layer is essential when the display structure is used in the ice application. This is already obvious from the previous paragraphs disclosing various display structures.

In the ice application, the clouding, i.e. transforming into less transparent, of the ice surface layer is a problem regarding the proper visibility of the display below it. This happens when the ice quality mechanically changes because of the skate movements along the ice by the players. The changing ice surface "indentations" also makes the light from the display to disperse. A second layer of the display structure may act as a clouding layer, i.e. a diffuser layer. The clouding layer may comprise small glass balls or polymer fiber, such as polypropylene. Such a clouding layer may locate as an extra layer between the other layers, or it can be placed in the surface of the display structure (the top side). The clouding layer acts as an artificial dispersing element for the light coming from the LEDs of the display structure. This will make the individual LEDs less distinguishable from one another, when the display is looked at from the stands of the ice hockey hall, for instance.

Furthermore, in the ice application applicable e.g. in various hockey arenas and the like, purified water (i.e. deionized water) can be preferably used for freezing process. In this way, there are less electrically conducting particles even in the case, if the water melts and intrudes into the display structure.

Furthermore, the display structure according to the invention can apply wireless connectivity means and/or IoT ("Internet of Things") connectivity means. In other words, the operation and the content of the display structure can be controlled through a wireless connection. In a further embodiment, the display structure can be implemented as an IoT device.

Generally speaking, different embodiments and sub-features of the display structure from the above can each be implemented with a corresponding manufacturing method. The order of the desired layers for the manufacture is already apparent from the above description.

The advantages of the invention are various. The structure is a modular one where the module size is freely scalable. The sizes of the display or illumination device is highly scalable for different purposes, allowing very large displays for public use and very small displays e.g. in a wristwatch type of a device. Furthermore, by adding holes to the structure, the transparency can be enhanced even more.

The layered structure enables the heat to be managed more easily, in order to direct the emerging heat out of the structure.

Further advantages of the ice display application and the outdoor display application have been already mentioned earlier within each specific embodiment.

Different embodiments disclosed in the dependent claims and in the details above may be combined with one another in order to achieve a new embodiment of the invention.

The present invention is not limited to the above presented embodiments but it may vary within the scope of the claims.

The invention claimed is:

1. A display structure comprising at least one display module, wherein the display structure comprises:

at least one substrate layer comprising polymer, glass, ceramic or composite materials and integrated electrically conductive circuitry with electronics, and light emitting devices:

at least one electrically conductive layer, enabling intelligent control of the light emitting devices;

wherein the display module comprises at least one coating or molded layer protecting the display structure from moist and other environmental effects;

wherein the display structure being constructed of display modules arranged in rows and columns;

plurality of structured and manufactured through-holes reaching through the whole display structure across the plurality of layers, wherein the through-holes form channels configured to propagate cooling effects, and wherein the through-holes are configured to provide water and/or air to flow through the display structure;

wherein the display structure is mountable on a fixed platform;

wherein the display structure is configured to be covered in water and when the display structure cools, an ice layer is formed; and wherein the through-holes are configured to provide support for the display structure by ice within the through-holes after cooling of the display structure and water.

2. The display structure according to claim 1, wherein the each display module of the display structure applicable in ice conditions is an individual display module protected from the effects of water and ionic substances by a multilayer coating, where the multilayer coating comprises:

a first layer providing chemically stable connection with outermost surfaces to be protected; and a second layer of elastomer thicker than the first layer and providing reduction in water and ionic substances diffusion rate, and mechanical protection against expansion taking place, when water freezes and provides mechanical protection to compensate for thermal expansion differences between ice and the display structure.

3. The display structure according to claim 2, wherein the first layer is manufactured from epoxy.

4. The display structure according to claim 2, wherein the second layer is manufactured from silicone.

5. The display structure according to claim 2, wherein the multilayer coating further comprises a perfluorinated polymer layer on top of the second layer.

6. The display structure according to claim 5, wherein a thickness of the perfluorinated polymer layer is selected from 1 .mu.m-5 .mu.m.

7. The display structure according to claim 2, wherein a thickness of the first layer is selected from 0.05 mm-0.2 mm.

8. The display structure according to claim 1, wherein the display structure for outdoor conditions comprises:

an epoxy layer on top of the electrically conductive circuitry, a silicone layer on top of the epoxy layer, and a planar glass layer on top of the silicone layer.

9. The display structure according to claim 8, wherein the epoxy layer and the planar glass layer are interconnected by support elements from desired locations, before the silicone layer is introduced.

10. The display structure according to claim 1, wherein an electrical connection to a selected layer or between the layers comprising the electronics is implemented by a connector filled with silicone gel in order to protect the connector from moisture.

11. The display structure according to claim 1, wherein the at least one substrate layer comprising the electronics and light emitting devices is an FR4 circuit board.

12. The display structure according to claim 1, wherein the display structure comprises an epoxy layer reinforced with a fiberglass net, laminated to a glass layer.

13. The display structure according to claim 1, wherein the display structure comprises the at least one substrate layer with the electronics and the light emitting devices, topped by a polymer layer, and further topped by a glass layer.

14. The display structure according to claim 1, wherein the display structure comprises the at least one substrate layer with the electronics and the light emitting devices, topped by a polymer layer, and further topped by a polypropylene layer.

15. The display structure according to claim 1, wherein the display structure comprises power and control circuitry on the at least one substrate layer that is transparent to allow general transparency of the display structure.

16. The display structure according to claim 1, wherein the display structure comprises two or more superimposed display modules to create denser pixel structure or higher illumination level.

17. The display structure according to claim 16, wherein the two or more superimposed display modules are used together with computer generated display controls directed separately to each superimposed display module in order to create 3D effects.

18. The display structure according to claim 1, wherein the display structure comprises reflectors for each light emitting device in order to collimate the light beam to a desired illumination angle and reduce optical interaction between adjacent light emitting devices.

19. The display structure according to claim 1, wherein the display structure comprises a diffuser layer, which diffuses light beams for more even illumination and enhanced optical properties of the display structure.

20. The display structure according to claim 19 wherein the diffuser layer comprises glass balls or polymer fiber.

21. The display structure according to claim 1, wherein protective layers comprise thermally insulating material or a thermally insulating layer is applied on top of one or more protective layers, that enables directing the dissipated heat by the display structure towards a desired side of the display structure in ice display applications.

22. The display structure according to claim 1, wherein the display structure and the electronics comprise tin-coated copper wires.

23. The display structure according to claim 1, wherein the display structure further comprises wireless connectivity.

24. The display structure according to claim 23, wherein the display structure further comprises IoT connectivity.

25. A manufacturing method for manufacturing a display structure comprising at least one display module, wherein the manufacturing method comprises the steps of:

manufacturing each layer of at least one substrate layer comprising polymer, glass, ceramic or composite materials and integrated electrically conductive circuitry with electronics, and light emitting devices;

manufacturing at least one electrically conductive layer, enabling intelligent control of the light emitting devices;

manufacturing, for each display module, at least one coating or molded layer protecting the display structure from moist and other environmental effects;

constructing the display structure from display modules by interconnecting a plurality of the display modules and arranging the interconnecting display modules in rows and columns;

routing or otherwise creating in the display structure a plurality of structured through-holes reaching through the whole display structure across the at least one substrate layer, the at least one electrically conductive layer and the at least one coating or molded layer, the through-holes forming channels to propagate cooling effects, the through-holes providing flow of water and/or air through the display structure;

mounting the display structure on a fixed platform;

supplying water to the display structure;

cooling the display structure and water to form ice on the display structure, wherein ice formed in the through-holes after the cooling provides mechanical support for the display structure.

26. The manufacturing method according to claim 25, further comprising the step of:

dipping a substrate to a coating material to form a display structure comprising a coating layer.

27. The manufacturing method according to claim 25, further comprising the step of:

using copper wires in the electronics which copper wires are first coated with tin coating before the manufacturing of the layers takes place.

28. The manufacturing method according to claim 25, wherein the manufacturing of a layer can be implemented by laminating, spraying, electrostatic spraying, molding, injection molding, dipping, jetting, casting, or curtain coating.

29. The manufacturing method according to claim 25, wherein it further comprises:

an epoxy layer placed on top of a circuit board layer, a silicone layer placed on top of the epoxy layer, and a planar glass layer placed on top of the silicone layer; and the epoxy layer and the planar glass layer are interconnected by support elements from desired locations, before the silicone layer is introduced.

30. The manufacturing method according to claim 25, wherein an electrical connection to a selected layer or between the layers comprising electronics is implemented by filling silicone gel to a connector in order to protect the connector from moisture.

* * * * *